US012122487B2

(12) United States Patent
Wilson

(10) Patent No.: US 12,122,487 B2
(45) Date of Patent: Oct. 22, 2024

(54) WATERSPORTS BOARD STORAGE RACK

(71) Applicant: ROSWELL CANADA INC., Acheson (CA)

(72) Inventor: Darrick J. Wilson, Edmonton (CA)

(73) Assignee: ROSWELL CANADA INC., Acheson (CA)

( * ) Notice: Subject to any disclaimer, the term of this patent is extended or adjusted under 35 U.S.C. 154(b) by 219 days.

(21) Appl. No.: 17/866,831

(22) Filed: Jul. 18, 2022

(65) Prior Publication Data

US 2023/0045830 A1 Feb. 16, 2023

Related U.S. Application Data

(60) Provisional application No. 63/232,825, filed on Aug. 13, 2021.

(51) Int. Cl.
*B63B 32/83* (2020.01)

(52) U.S. Cl.
CPC ..... *B63B 32/83* (2020.02)

(58) Field of Classification Search
CPC ..... B63B 32/83; B63B 34/67
USPC ..... 248/316.4; 224/406
See application file for complete search history.

(56) References Cited

U.S. PATENT DOCUMENTS 5,316,192 A * 5/1994 Ng ..... B60R 9/048 224/324
5,752,638 A * 5/1998 Meeks ..... B63B 25/002 224/558
6,164,507 A * 12/2000 Dean ..... B60R 9/08 224/570
6,789,712 B2 * 9/2004 Gates ..... B60R 9/048 224/446
10,870,468 B1 * 12/2020 Hellweg ..... B63B 32/40
11,873,063 B1 * 1/2024 Boyd ..... B63B 32/83
2021/0261222 A1 * 8/2021 Hellweg ..... B63B 32/83

OTHER PUBLICATIONS

Roswell Triton II, Concept presentation 21/03, Mar. 1, 2021, 10 pages.
Roswell Triton Strapless Board Rack, printed on Nov. 29, 2022 from https://www.roswellmarine.com/product/triton-strapless-board-rack/, 2 pages.

* cited by examiner

*Primary Examiner* — Todd M Epps
(74) *Attorney, Agent, or Firm* — Timothy H. Van Dyke; Wolter, Van Dyke, Davis, PLLC

(57) ABSTRACT

An apparatus (100), including: a lower support structure (102) configured to support a bottom side of a board disposed thereon, wherein the board can be any one of a variety of various sized boards; and an adjustable clamp head (104) including a resilient structure (122) that defines a recess (124) configured to capture therein a top side of the board and thereby hold the board between the clamp head and the lower support structure when the clamp head is lowered onto the top side of the board. The resilient structure is configured to narrow the recess when the clamp head is lowered against a resilience of the resilient structure onto a relatively thin board sized to contact the resilient structure at an apex (130) of the recess without fully filling an opening (132) of the recess.

15 Claims, 19 Drawing Sheets

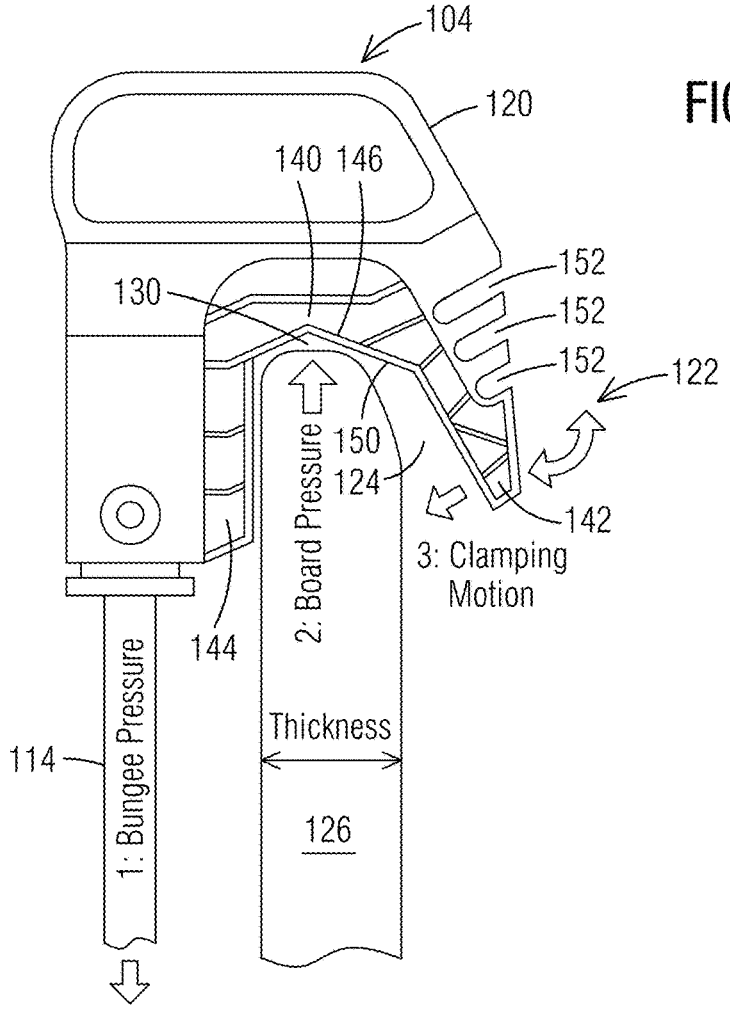
FIG. 5A
FIG. 5D
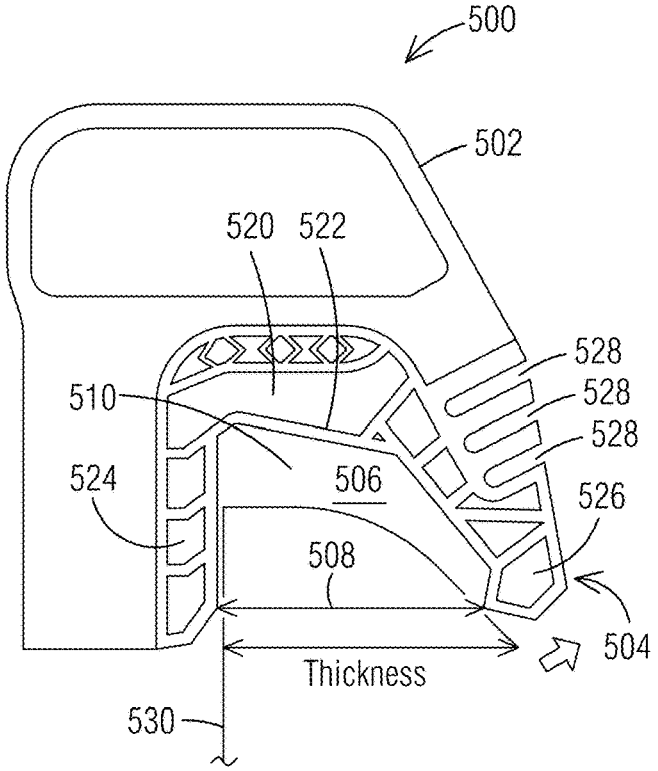

WATERSPORTS BOARD STORAGE RACK

FIELD OF THE INVENTION

The invention relates to a watersports board storage rack.

BACKGROUND OF THE INVENTION

Watersports equipment such as surfboards and wakeboards can occupy a significant amount of space in the passenger area of a marine vessel. Various racks have been devised to store the boards out of the passenger area. An example is a Triton Strapless Board Rack made by Roswell Global Inc., of Rockledge, FL. While these racks provide storage solutions, there remains room in the art for improvement.

BRIEF DESCRIPTION OF THE DRAWINGS

The invention is explained in the following description in view of the drawings that show:

FIG. 5A to 5C show an example embodiment of a clamp head of the watersports board storage rack of FIG. 1.

FIG. 5D shows an alternate example embodiment of the clamp head.

DETAILED DESCRIPTION OF THE INVENTION

Figure 1:
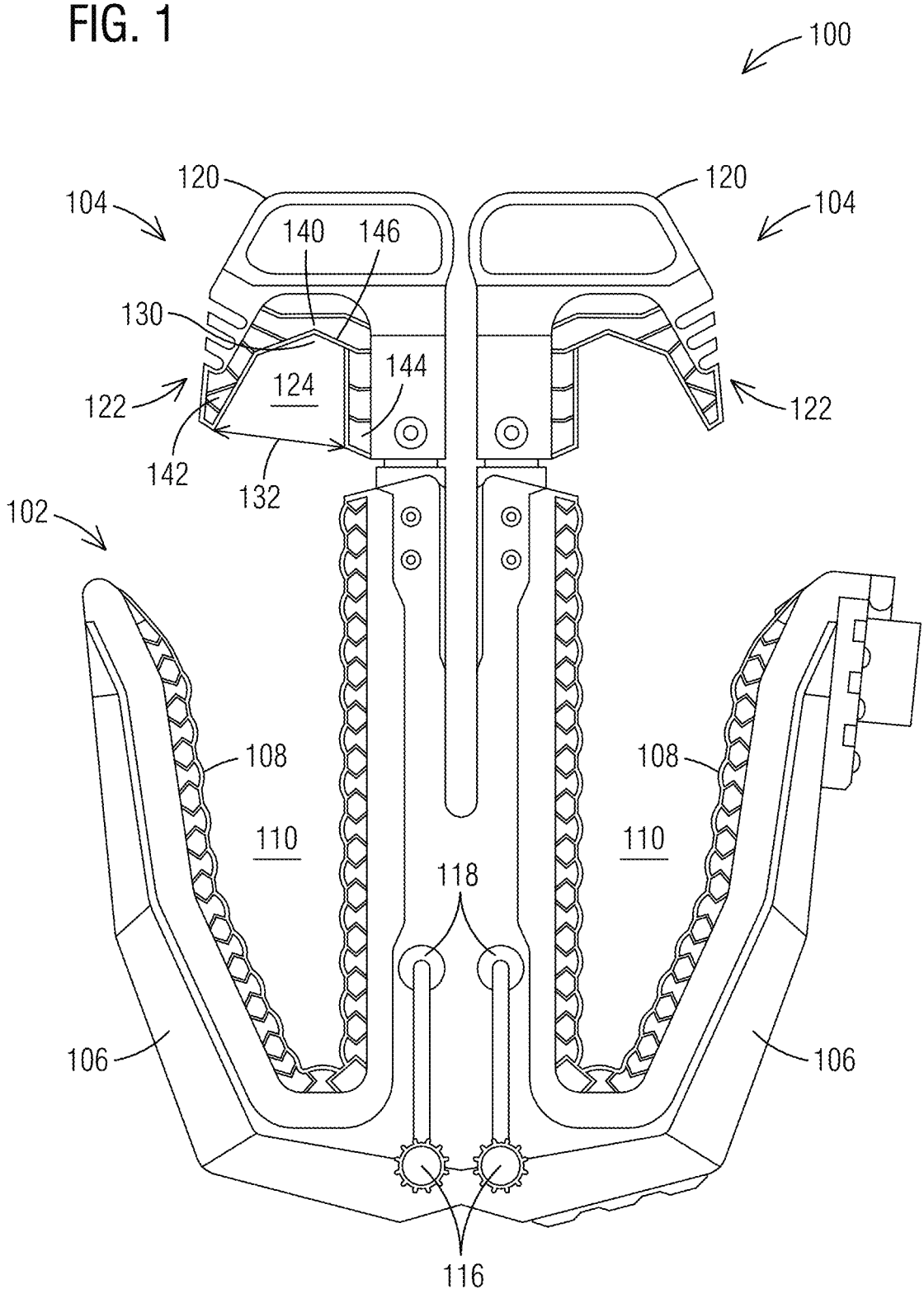
FIG. 1 is a side view of an example embodiment of a watersports board storage rack in a vertical position.
Figure 2:
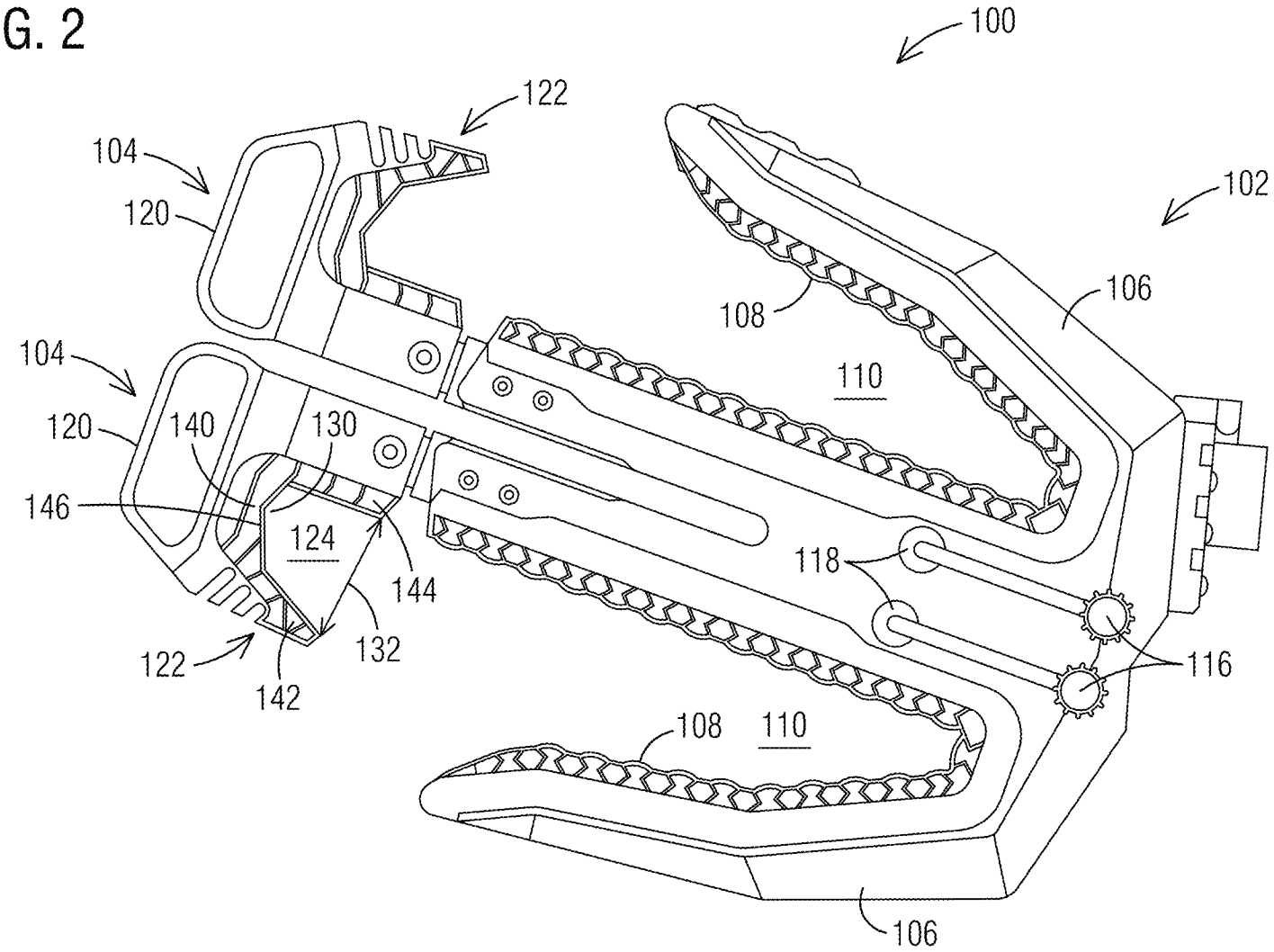
FIG. 2 is a side view of the watersports board storage rack of FIG. 1 in a horizontal position.
Figure 3:
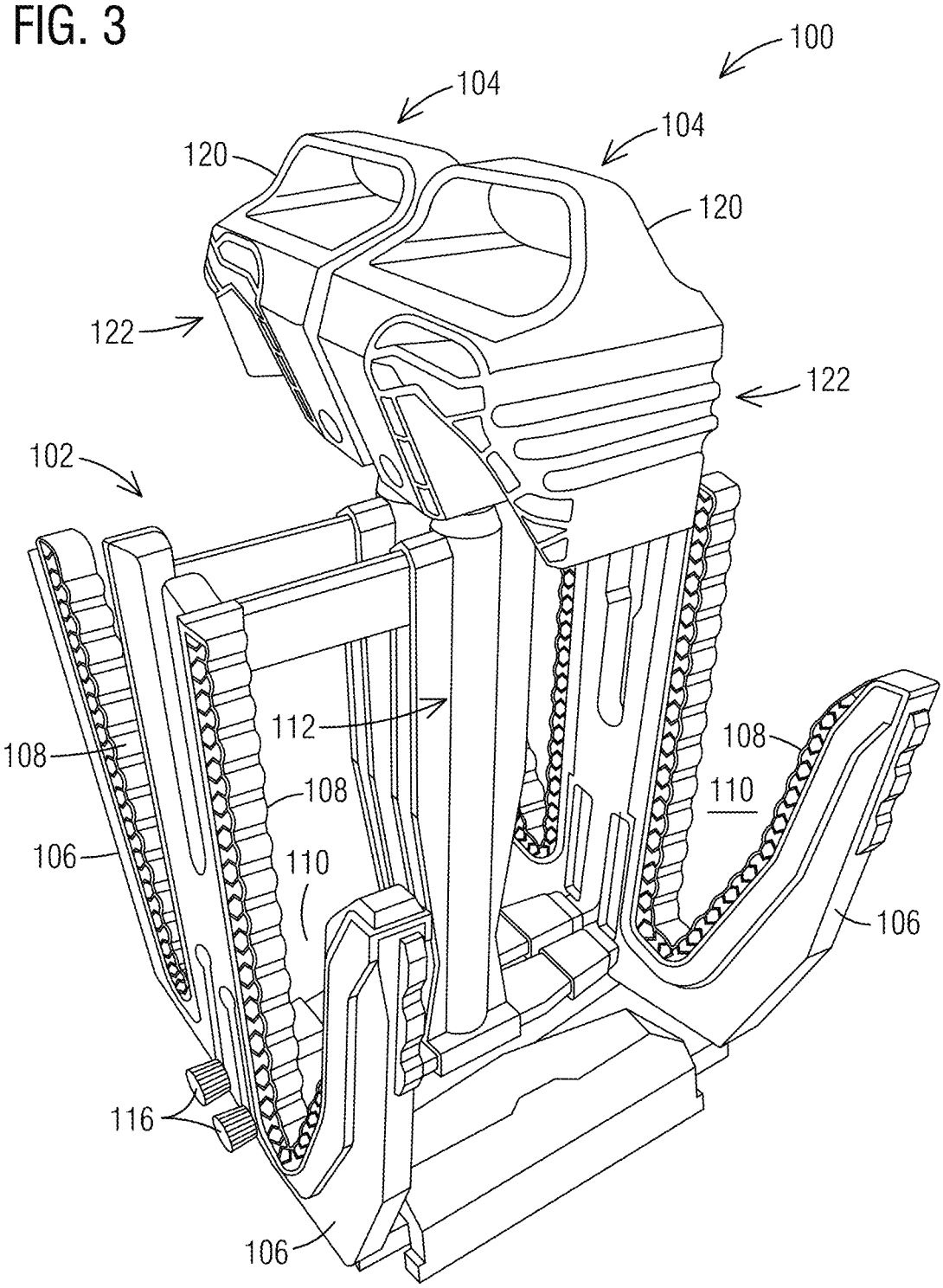
FIG. 3 and FIG. 4 are perspective views of the watersports board storage rack of FIG. 1.

The present inventor has devised a unique and innovative board storage rack ("rack") in which a single resilient structure is able to automatically accommodate boards of varying thicknesses. In an example embodiment, the board storage rack is a watersports board storage rack, though it can be used to store other types of boards. This simplifies operation, reduces cost, and virtually eliminates maintenance when compared to a more complex mechanical assembly.

FIG. 1 to FIG. 4 show different views of an example embodiment of an apparatus 100 (e.g., a rack) sized and shaped to support any one of a variety of various sized boards. The apparatus 100 includes a lower support structure 102 configured to support a bottom side (a.k.a. bottom edge, bottom end) of a board disposed thereon and an adjustable clamp head 104. The lower support structure 102 in an example embodiment includes two (e.g., U-shaped) lower supports 106 spaced apart from each other and configured to support the bottom side of the board. Each lower support 106 includes an optional pillow/cushion 108 that contours to and protects a board, and each defines a lower support recess 110 configured to receive the bottom side of the board. Outer ends of the lower supports 106 may be angled/ramped outward as shown to guide a board into the lower support recesses 110.

In the example embodiment shown, the apparatus 100 includes two clamp heads 104 and two lower supports 106 for each clamp head 104. Alternately, the apparatus 100 can include only one clamp head 104 and two lower supports 106 for the clamp head 104.

Figure 4:
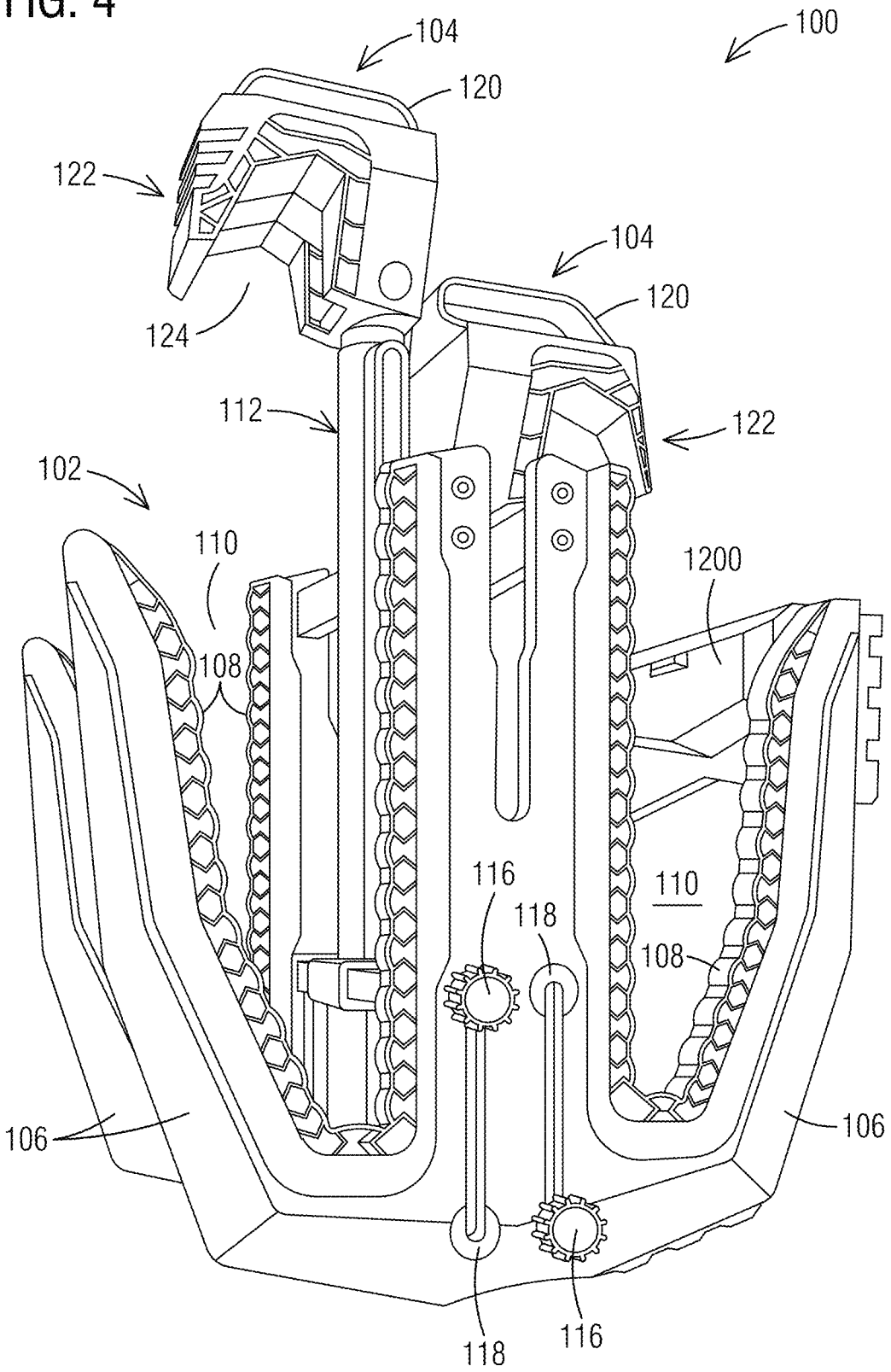

As can be seen in FIG. 4, the apparatus 100 further includes a clamp assembly 112 to which the clamp head 104 is secured. The clamp assembly includes a bungee 114 (see FIG. 5A) disposed therein that is under tension and thereby urges the clamp head 104 downward toward the lower supports 106. The clamp assembly 112 is itself adjustable between a lowered position shown on the right in FIG. 4 and a raised position shown on the left in FIG. 4 to accommodate a variety of boards of differing sizes (e.g., up to twenty-three (23) inches). The clamp assembly 112 can be held in the respective position via an adjustment knob 116 that seats into a respective locking recess 118 when tightened.

Figure 5B:
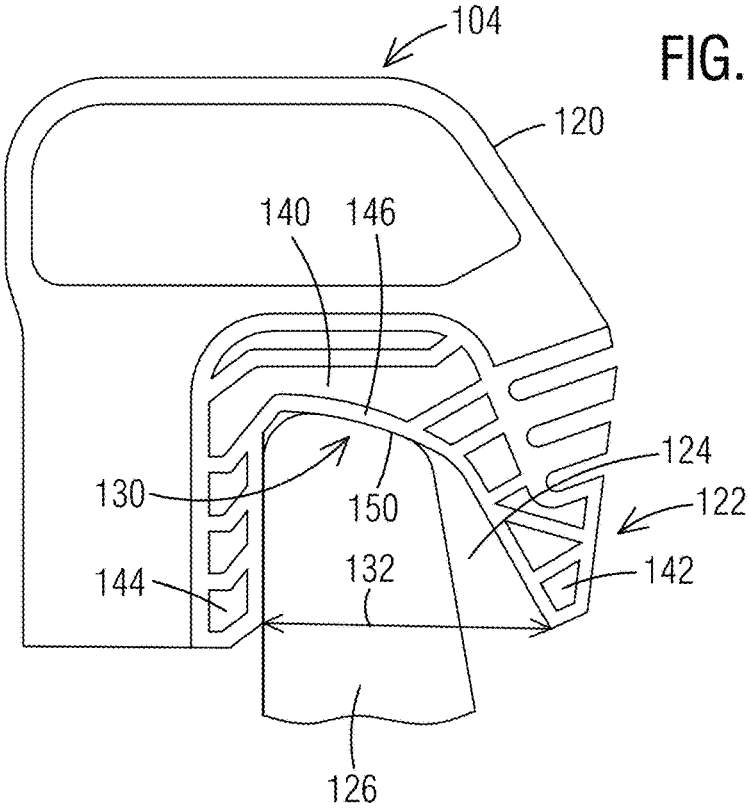
Figure 5C:
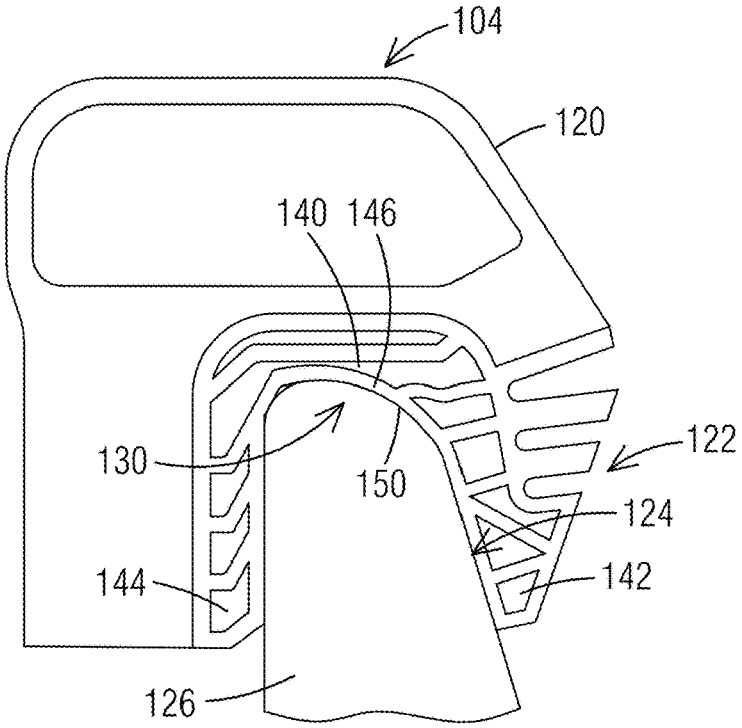

As can be seen in FIG. 5A to FIG. 5C, the adjustable clamp head 104 includes a rigid support 120 and a resilient structure 122 (a.k.a. a compliant clamping hinge) secured thereon that defines a recess 124 configured to capture therein a top side (a.k.a. bottom edge, bottom end) of the board and thereby hold the board between the clamp head 104 and the lower support structure 102 when the clamp head 104 is lowered onto the top side of the board. The resilient structure 122 can be made of any suitable resilient material, including thermoplastic elastomers, thermoplastic polyurethane, rubber, or any soft materials between shore hardness 30A-95A. In an example embodiment, the resilient structure 122 is a one-piece/monolithic part that is molded in a single operation. Alternately, the resilient structure 122 may be composed of more than one piece. In the example embodiment shown, the resilient structure 122 has a lattice/matrix shape where relatively thin elements provide the structure and function. The thin elements include the tension element 146 and the elements between the tension element 146 and the rigid support 120. However, this exact type of arrangement is not necessary.

The resilient structure 122 is configured to narrow the recess 124 when the clamp head 104 is lowered against a resilience of the resilient structure onto a relatively thin board 126 sized to contact the resilient structure 122 at an apex 130 of the recess 124 without fully filling an opening 132 of the recess 124 when the resilient structure 122 is in an unflexed state (see e.g., FIG. 1). The resilient structure 122 includes a central region 140 that at least partly defines the apex 130 of the recess, a lip 142 that at least partly defines the opening 132 of the recess 124, and a stationary side 144 that is disposed on an opposite side of the central region 140 from the lip 142. The central region 140 includes a tension element 146 that at least partly defines the apex 130 of the recess 124 and that is connected to the lip 142.

Once the relatively thin board 126 contacts the tension element 146, when the clamp head 104 is further lowered against a resilience of the resilient structure 122 the tension element 146 yields upward. While yielding upward, the tension element 146 may optionally at least partly conform to a shape of the relatively thin board 126. Since the tension element 146 is connected to the lip 142, and since the relatively thin board 126 does not fully fill the opening 132, this upward yielding pulls the lip 142 as shown by the arrow in FIG. 5A, thereby narrowing the opening 132. As seen in FIG. 5C, the clamp head 104 is configured to narrow the opening 132 of the recess 124 until a size of the opening 132 matches a thickness of the relatively thin board 126. This action clamps the resilient structure 122 onto the relatively thin board 126

In an example embodiment, the opening 132 of the recess 124 in the unflexed state ranges from 1.5 inches to 2.5 inches. In an example embodiment, the opening 132 ranges from 2 inches to 2.25 inches. In an example embodiment, the clamp head 104 is configured to narrow the opening 132 of the recess 124 by up to 1.0 inches when lowered against the resilience of the resilient structure onto the relatively thin board 126. In an example embodiment, the clamp head 104 is configured to narrow the opening 132 of the recess 124 by up to 0.625 inches when lowered against the resilience of the resilient structure onto the relatively thin board 126.

In an example embodiment, the central region 140 is shaped to urge the relatively thin board 126 against the stationary side 144 as the clamp head 104 settles onto the relatively thin board 126. In the example embodiment shown, this is achieved by angling the tension element 146 so that at least a part of the tension element 146 forms a ramp 150 that urges the relatively thin board 126 toward the stationary side 144. In the example embodiment shown, the ramp 150 forms an acute angle with the stationary side 144.

The clamp head 104 can thereby provide several points of contact for the relatively thin board 126, including the stationary side 144, the lip 142, and one or more points on the tension element 146, and thereby hold the relatively thin board securely.

In addition to the above functions, the lip 142 is configured to yield to a board that is being loaded into the apparatus 100. Since the lower supports 106 are protected with the pillows 108, and since the lip 142 is composed of a resilient material that is therefore not rigid, a board being inserted into the apparatus 100 will not encounter any rigid structures that might damage the board. Further, if the board is approaching the maximum size (e.g., twenty-three (23) inches), the lip 142 can deflect inward to let the board into the recess 124.

In an example embodiment, the resilient structure 122 includes one or more relief notches 152 disposed adjacent the lip 142 and configured to make it easier for the lip 142 to move/deflect. In the example embodiment shown, the relief notches 152 widen when the lip narrows the recess 124. However, the relief notches could alternately be disposed inside the recess and narrow when the lip narrows the recess 124.

The resilient structure 122 is also configured to widen the recess 124 when the clamp head 104 is lowered against the resilience of the resilient structure 504 onto a relatively thick board sized to fully fill the opening 132 before contacting the resilient structure 122 at the apex 130 of the recess 124. This functionality is described below with respect to the example embodiment shown in FIG. 5D, but applies equally to the other embodiments disclosed herein, such as the example embodiment of FIG. 1 to FIG. 5C.

FIG. 5D shows an alternate example embodiment of a clamp head 500. Like the example embodiment of FIG. 1 to FIG. 5C, the clamp head 500 is also configured to narrow the recess when the clamp head 500 is lowered against a resilience of the resilient structure onto a relatively thin board 126 sized to contact the resilient structure at an apex of the recess without fully filling an opening of the recess when the resilient structure is in an unflexed state. Also like the example embodiment of FIG. 1 to FIG. 5C, the clamp head 500 is configured to widen the recess when the clamp head 500 is lowered against the resilience of the resilient structure onto a relatively thick board sized to fully fill the opening before contacting the resilient structure at the apex of the recess. The example is merely an alternate example embodiment to show alternate structure.

The clamp head 500 includes a rigid support 502, a resilient structure 504 secured thereon that defines a recess 506 with an opening 508 and an apex 510, a central region 520 with a tension element 522, a stationary side 524, a lip 526, and relief notches 528. The resilient structure 504 is configured to widen the recess 506 when the clamp head 500 is lowered against the resilience of the resilient structure 504 onto a relatively thick board 530 sized to fully fill the opening 508 before contacting the resilient structure 504 at the apex 510 of the recess 506. This is achieved by allowing the lip 526 to deflect outward as indicated by the arrow in FIG. 5D as the clamp head 500 is lowered against the resilience of the resilient structure 504 to accommodate the thickness of the relatively thick board 530. As the lip 526 is deflected outward the resilience of the resilient structure 504 resists the deflection, and the resistance to the deflection urges the relatively thick board 530 against the stationary side 524 as the clamp head 500 settles onto the relatively thick board 530. The relief notches 528 shown narrow when the lip 526 deflects outward to widen the opening 508.

The clamp head 500 can thereby provide plural points of contact for the relatively thick board 530, including the stationary side 524 and the lip 526 and thereby hold the relatively thick board 530 securely.

In an example embodiment, the opening 132 of the recess 124 in the unflexed state ranges from 1.5 inches to 2.5 inches. In an example embodiment, the opening 132 ranges from 2 inches to 2.25 inches. In an example embodiment, the clamp head 500 is configured to widen the opening 508 of the recess 506 to up to 4.5 inches. In an example embodiment, the clamp head 500 is configured to widen the opening 508 of the recess 506 to up to 3.375 inches.

As noted above, all of the clamp head embodiments disclosed herein are configured to clamp down on relatively thing boards and to expand to accommodate relatively thick boards.

Figure 6:
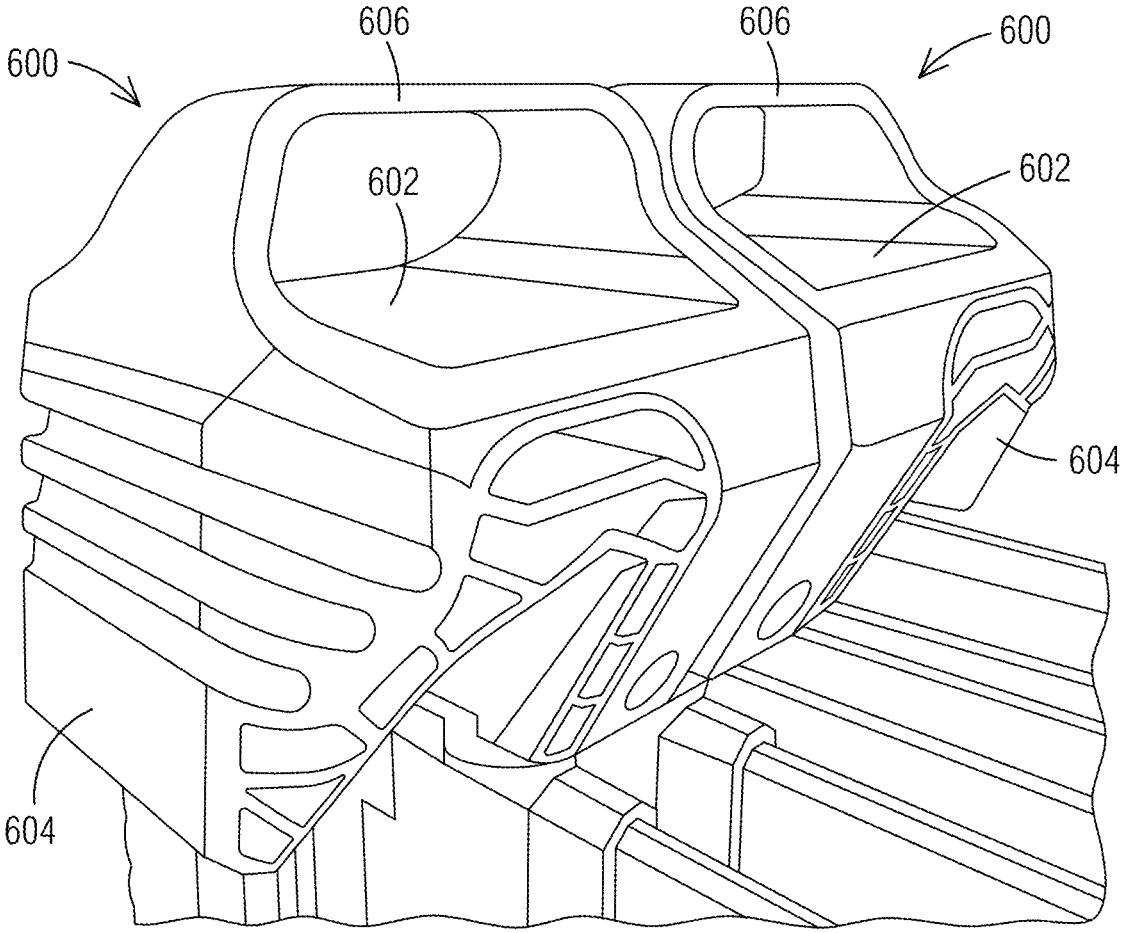
FIG. 6 shows a closeup of an example embodiment of the clamp head.

FIG. 6 shows a closeup of an example embodiment of the clamp head 600 having a rigid support 602 and a resilient structure 604 that is overmolded onto the rigid support 602. Alternately, the resilient structure 604 can be mechanically attached to the rigid support 602. Further included is a handle 606 suitable for lifting and lowering the clamp head 600.

Figure 7:
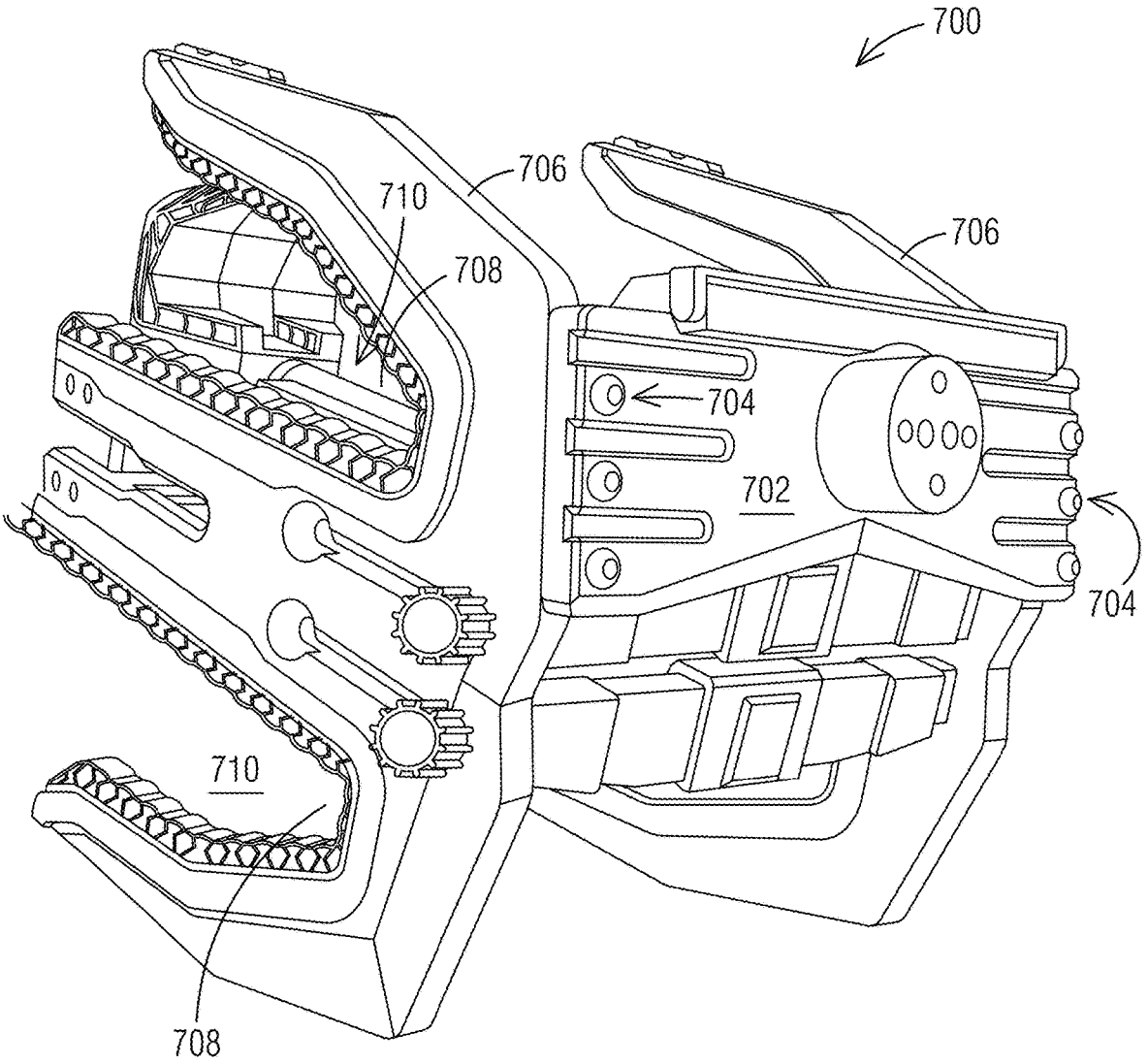
FIG. 7 shows an example embodiment of a mounting bracket mounted to a set of mounting holes suitable to orient the watersports board storage rack of FIG. 1 horizontally.
Figure 8:
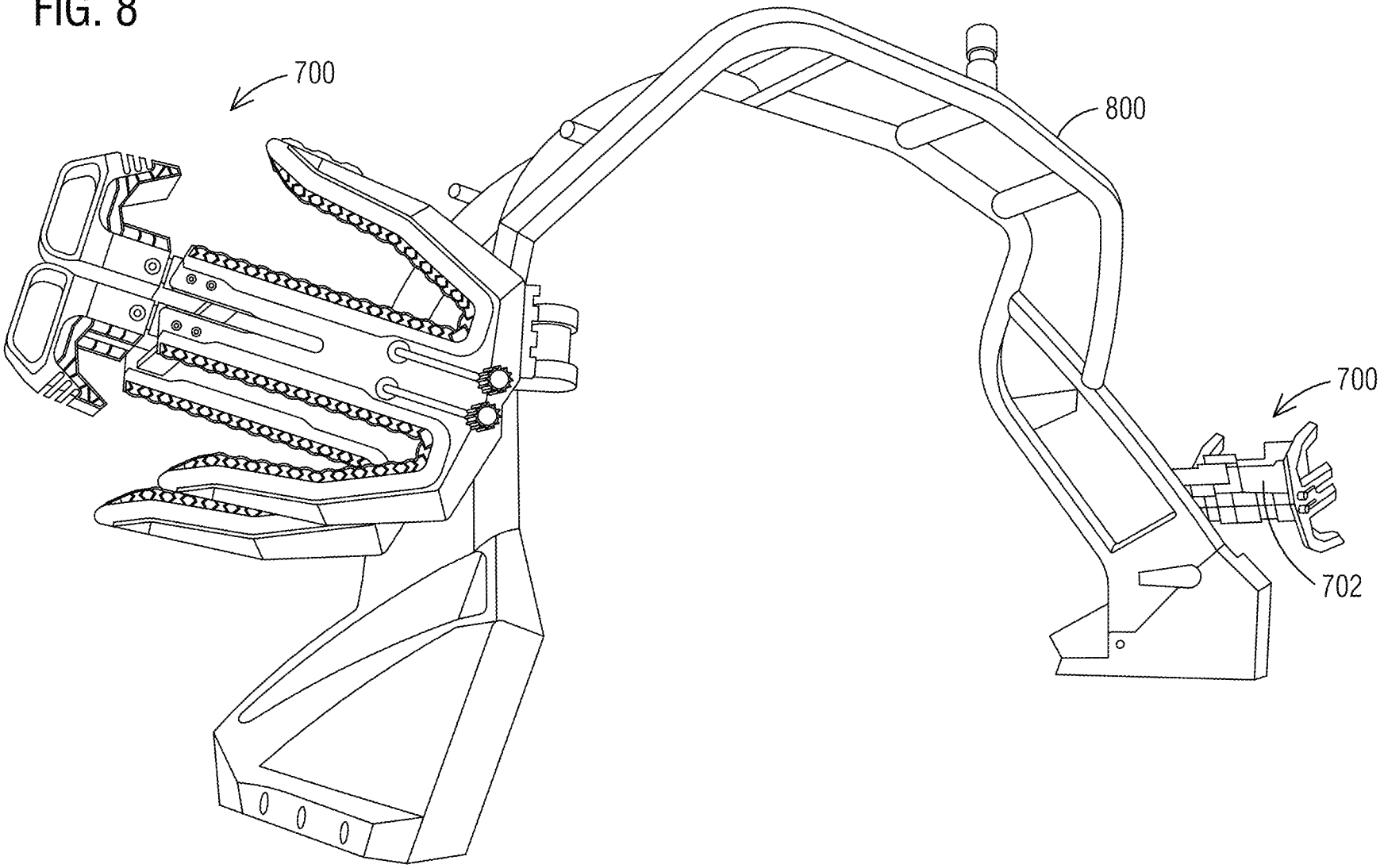
FIG. 8 shows the watersports board storage rack of FIG. 1 horizontally mounted to an example embodiment of a tower of a marine vessel.

FIG. 7 shows an example embodiment of an apparatus 700 with a mounting bracket 702 mounted to a first set of mounting holes 704 disposed on lower support outside surfaces 706 proximate an apex 708 of the lower support recess 710. The first set of mounting holes 704 is suitable to orient the apparatus 700 horizontally on an example embodiment of a boat tower 800 as shown in FIG. 8. While only two sets of mounting holes are shown, sets of mounting holes in other locations are also possible.

Figure 9:
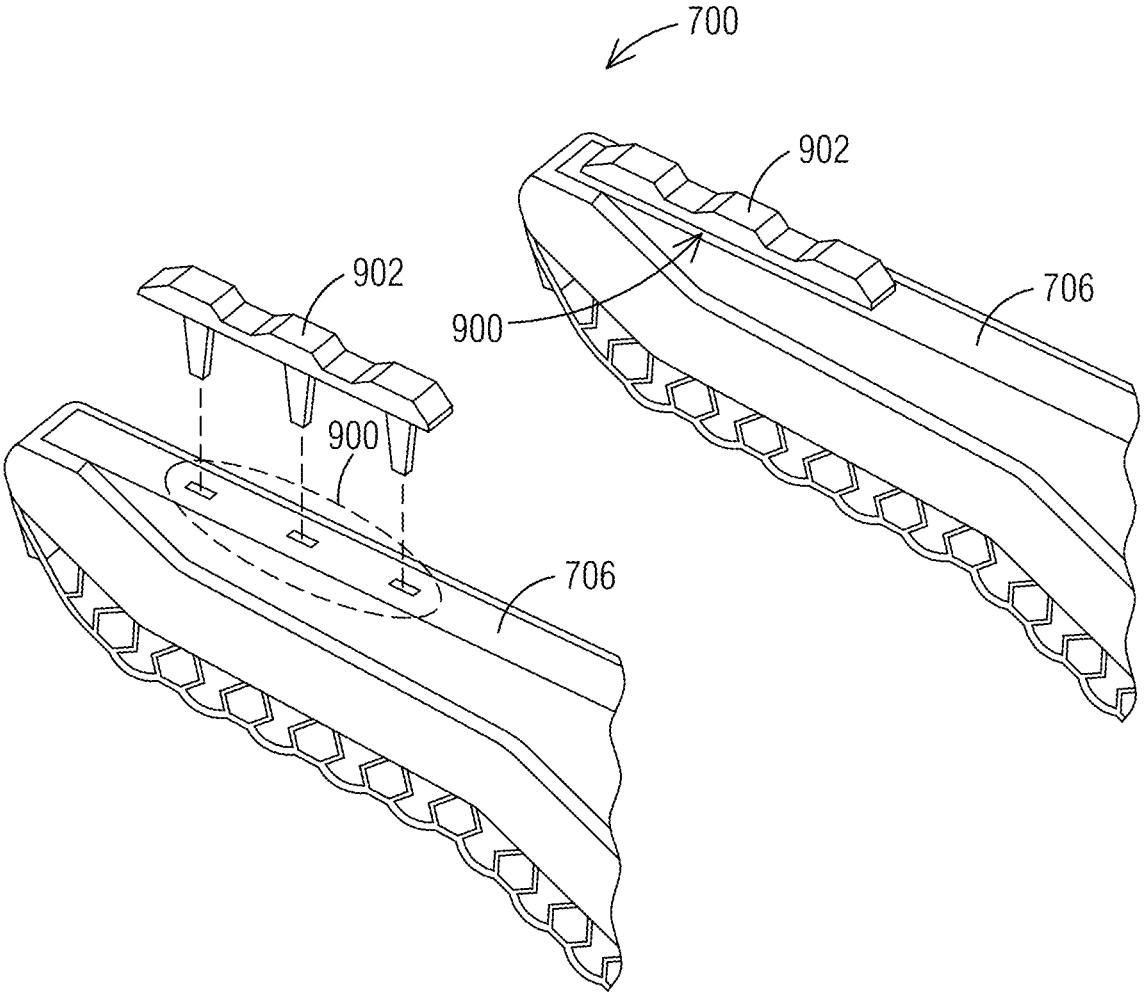
FIG. 9 shows an example embodiment of a set of mounting holes suitable to orient the watersports board storage rack of FIG. 1 vertically
Figure 10:
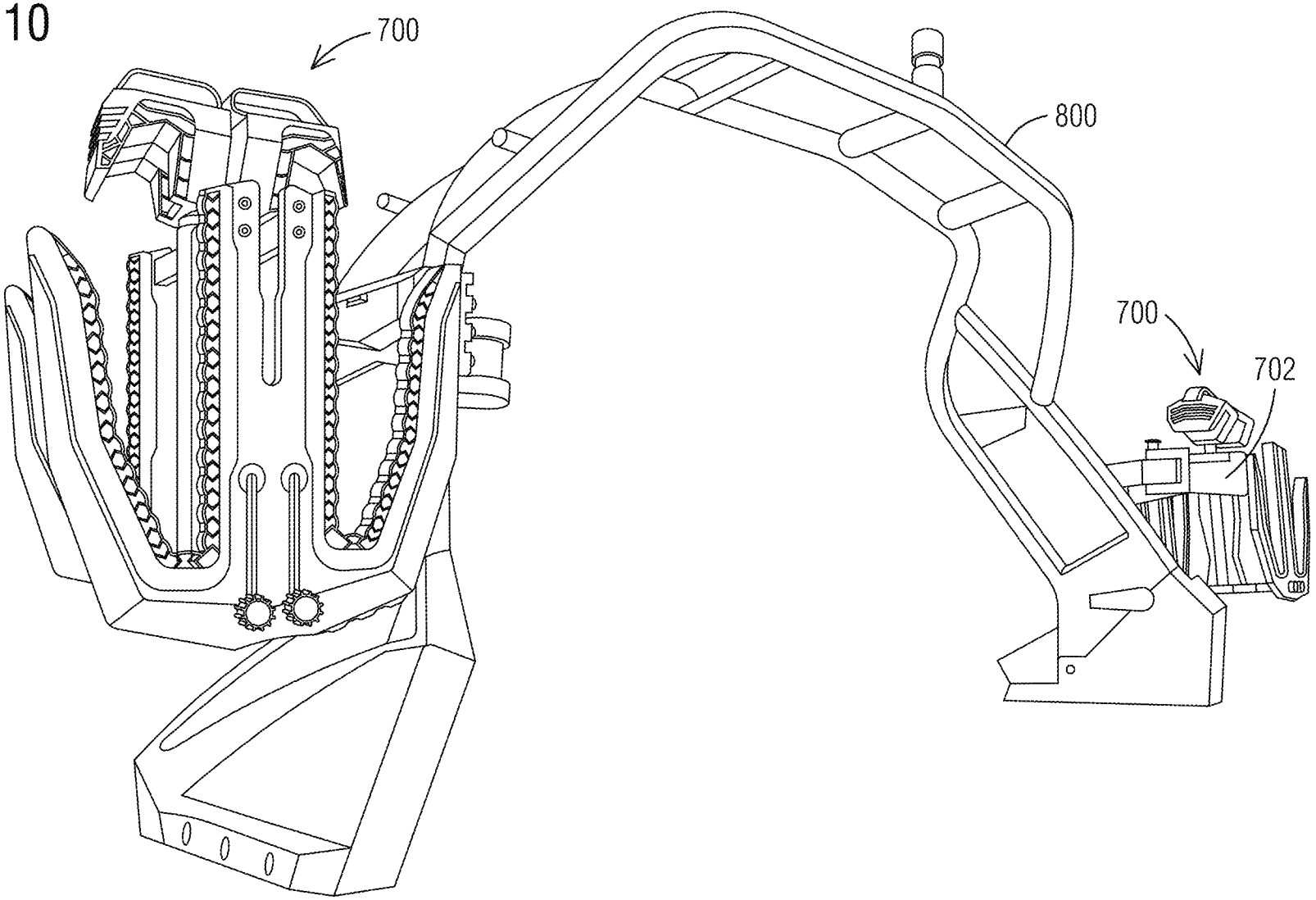
FIG. 10 shows the watersports board storage rack of FIG. 1 vertically mounted to the tower of FIG. 8.

FIG. 9 shows a second set of mounting holes 900 of the apparatus 700 disposed on the lower support outside surfaces 706 and distal from the apex 708 of the lower support recess 710. Optional hole plugs 902 can be disposed on any of the sets of holes. The second set of mounting holes 900 is suitable to orient the apparatus 700 vertically on the boat tower 800 as shown in FIG. 10.

Figure 11A:
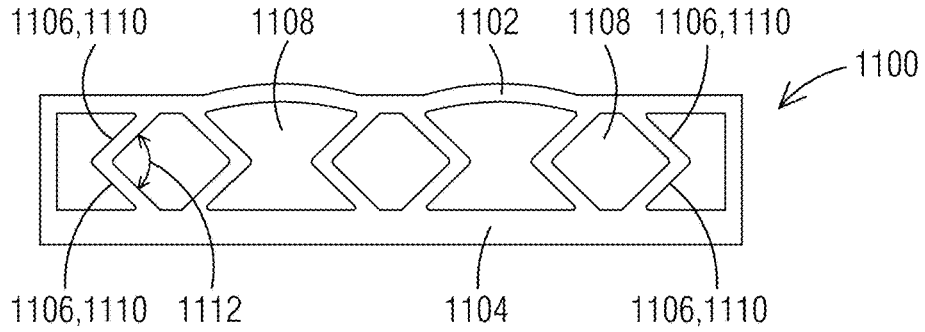
FIG. 11A to FIG. 11D show an example embodiment of structure suitable for use in an example embodiment of a pillow.
Figure 11B:
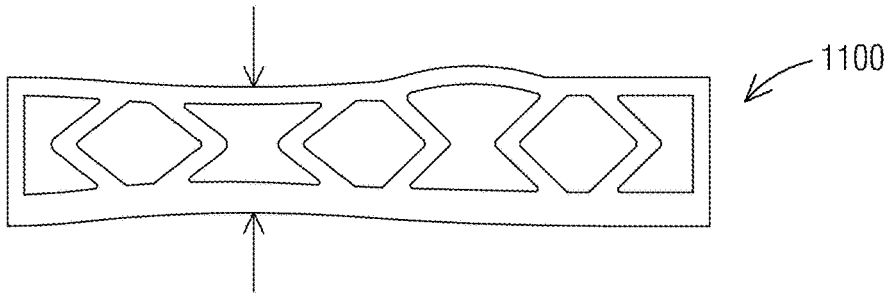
Figure 11C:
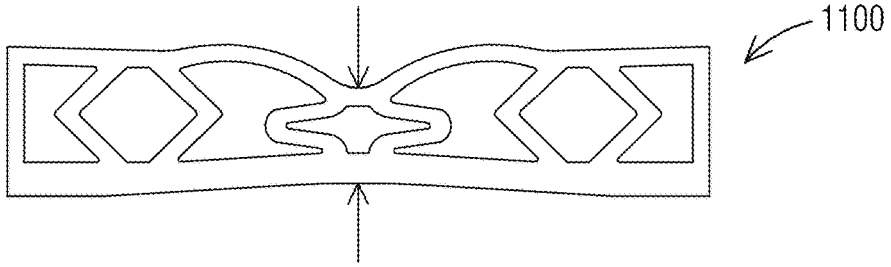
Figure 11D:
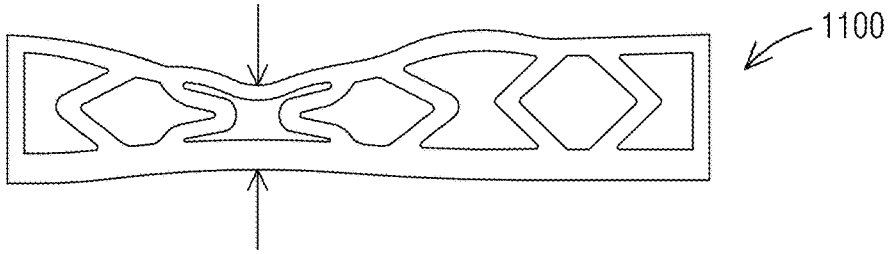

FIG. 11A to FIG. 11D show a portion of an example embodiment of the pillow 1100 disposed on the lower supports 106. The pillows 1100 may be composed of any suitable resilient material, such as thermoplastic elastomers, thermoplastic polyurethane, rubber, or any soft materials between shore hardness 30A-95A. FIG. 11A shows the pillow 1100 in a relaxed state without a board resting thereon. FIG. 11B shows minor compression of the pillow 1100 under minor pressure. FIG. 11C and FIG. 11D show additional compression of the pillow 1100 under additional pressure. In this example embodiment, each pillow includes a first contact strip 1102 and a second contact strip 1104 held apart from the first contact strip 1102 by spring structures 1106 embodied in this example embodiment as zig-zag columns. A thickness of the first contact strip 1102 may be from 0.1 inches to 0.05 inches. A thickness of the second contact strip 1104 may be from 0.12 inches, +/−1/16 inch. The spring structures 1106 are separated from each other by respective gaps 1108 ranging in size from 0.1 inches to 0.5 inches. A thickness of the spring structures 1106 may be from 0.0625 inches+/−1/32 inch. In the relaxed state, individual segments 1110 of the spring structures 1106 may be disposed relative to each other at an acute angle 1112 ranging from 60 degrees to 90 degrees. In an example embodiment, the angle 1112 is 90 degrees. There may be any number of individual segments 1110 in a spring structure 1106.

Figure 12A:
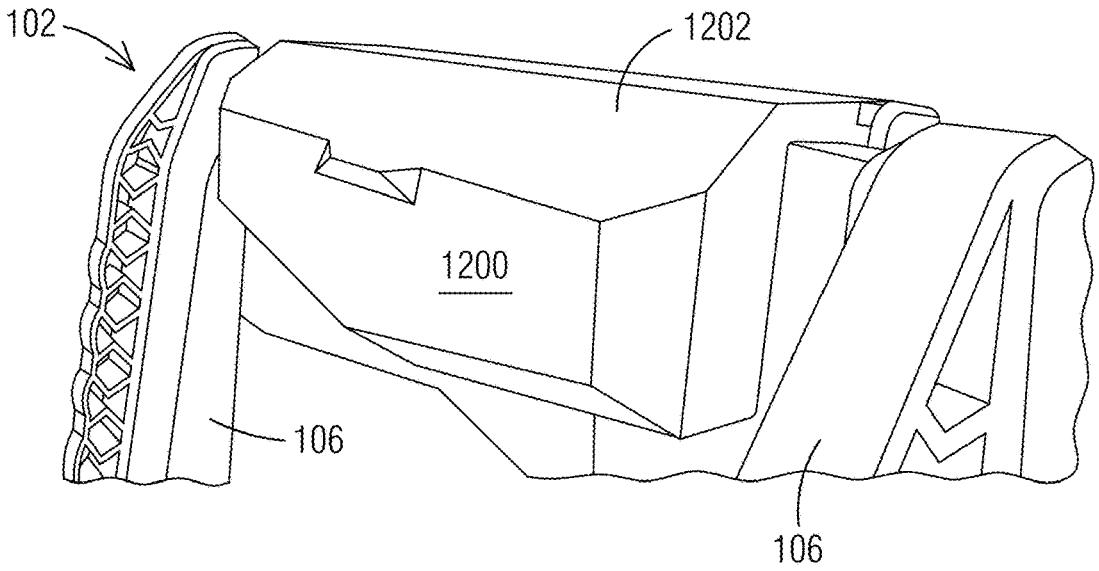
FIG. 12A to 12B show an example embodiment of a storage compartment for the watersports board storage rack of FIG. 1.
Figure 12B:
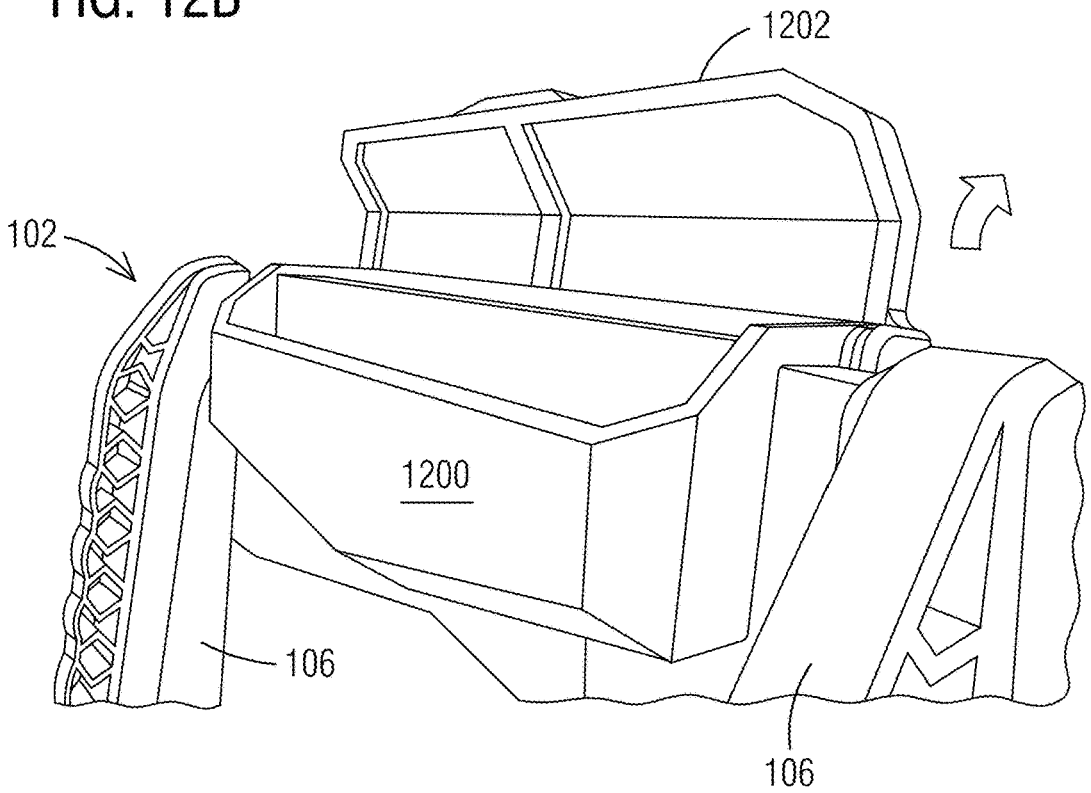

FIGS. 12A and 12B show a storage compartment 1200 (see also, FIG. 4) with a lid 1202. In this example embodiment, the storage compartment 1200 is disposed on the lower support structure 102. In particular, the storage compartment 1200 can be disposed between the lower supports 106 of the lower support structure 102. The storage compartment can serve as a stash housing for a cover for the apparatus 100. The cover can be composed of, for example, a textile (e.g., fabric such as ripstop nylon) that readily compacts into the storage compartment 1200.

Figure 13A:
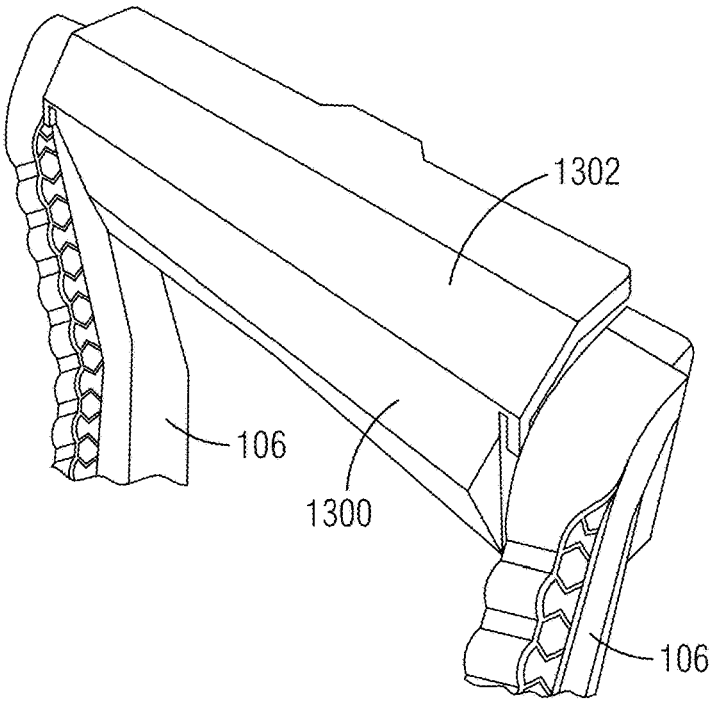
FIG. 13A to 13C show an alternate example embodiment of a storage compartment for the watersports board storage rack of FIG. 1.
Figure 13B:
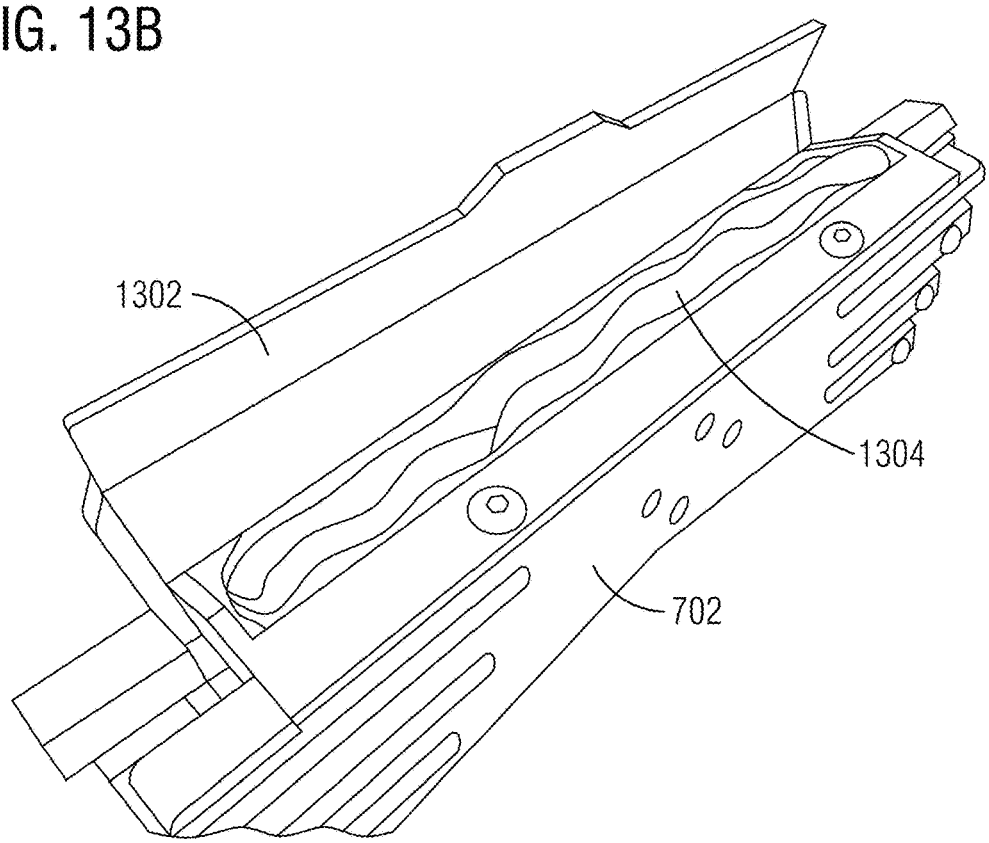
Figure 13C:
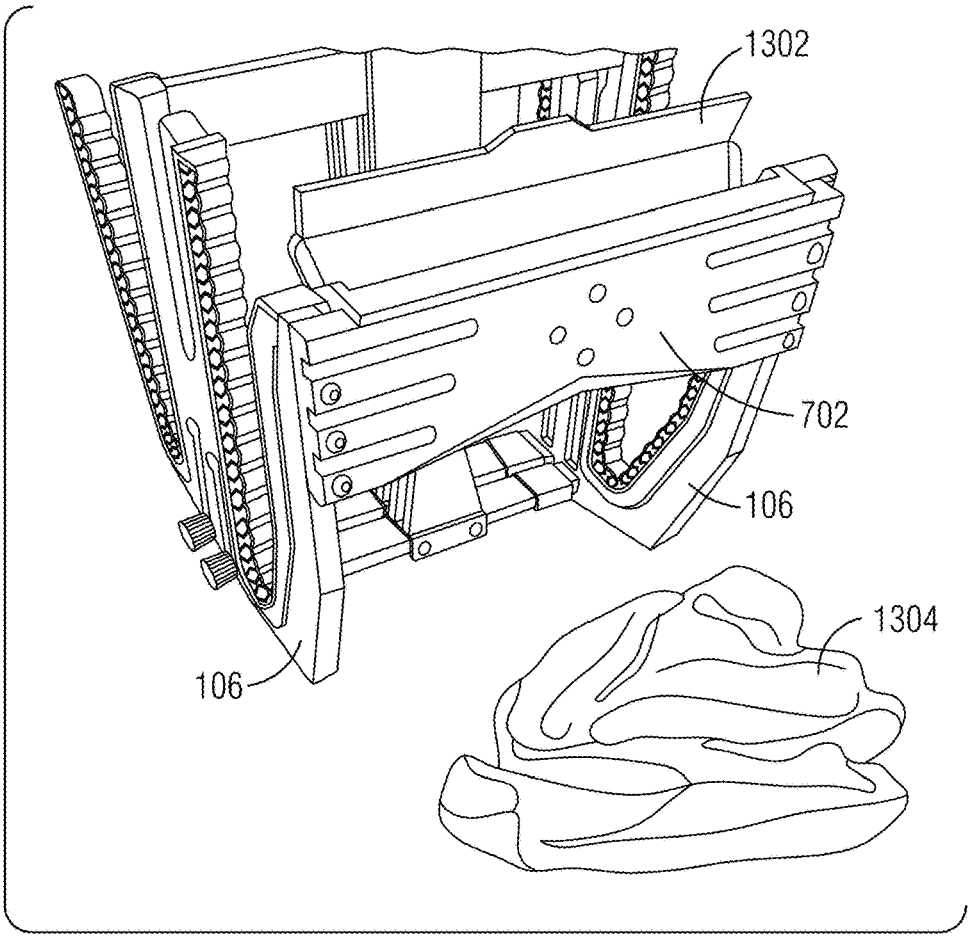
Figure 13D:
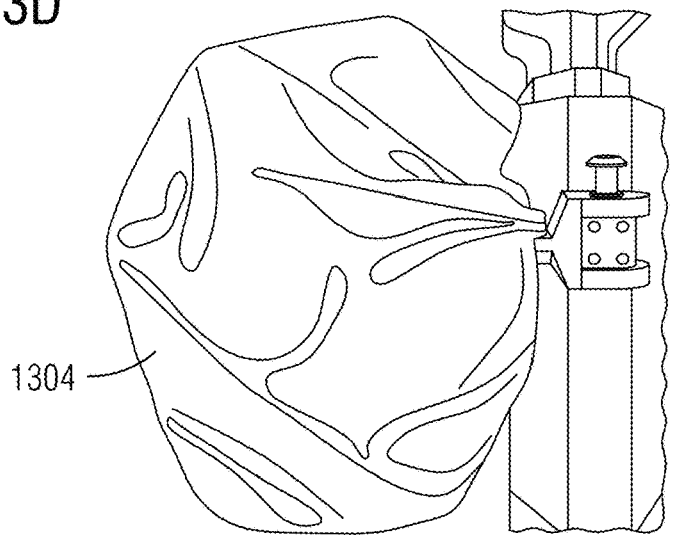
FIG. 13D shows an example embodiment of a cover on the watersports board storage rack of FIG. 1.

FIG. 13A to FIG. 13C show an alternate example embodiment of the storage compartment 1300 and lid 1302 disposed on the mounting bracket. Being disposed on the mounting bracket 702 enables the storage compartment 1300 to fit on the apparatus 100 when the apparatus is installed in either the horizontal or vertical positions. FIG. 13B shows the cover 1304 stashed in the storage compartment 1300 and FIG. 13D shows the cover 1304 disposed on the apparatus 100. In an example embodiment, the cover 1304 includes a cinching cord (e.g., paracord) and a cord lock that secure the cover 1304 to the apparatus 100.

Figure 14:
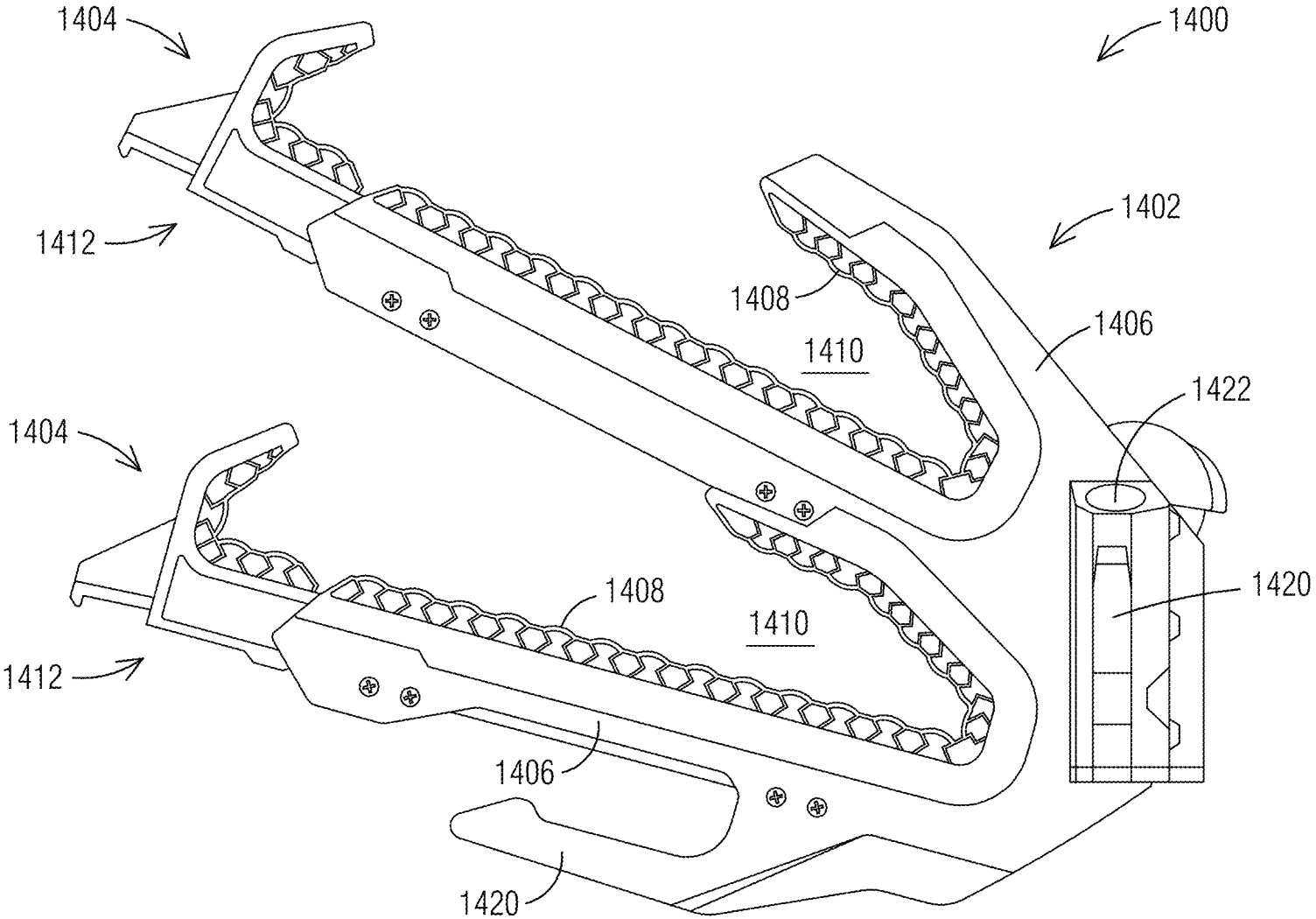
FIG. 14 and FIG. 15 show an alternate example embodiment of the watersports board storage rack.
Figure 15:
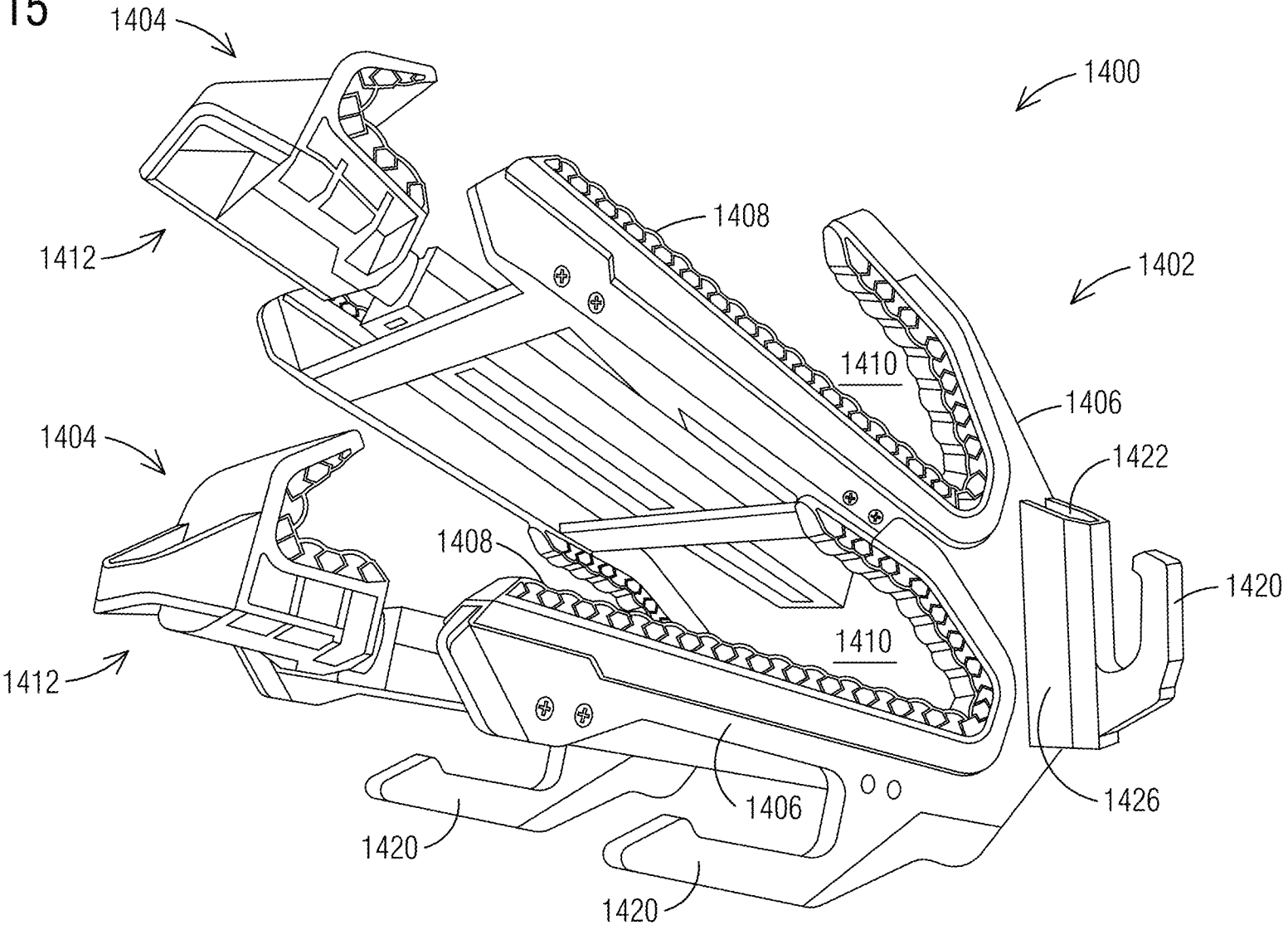

FIG. 14 and FIG. 15 show different views of an example embodiment of an apparatus 1400 (e.g., a rack) sized and shaped to support any one of a variety of various sized boards. Components and/or principles thereof disclosed for the apparatus 1400 may be the same or similar as for comparable components of the apparatus 100 of FIG. 1. The apparatus 1400 includes a lower support structure 1402 configured to support a bottom side of a board disposed thereon and an adjustable head 1404. The adjustable head 1404 may optionally be an adjustable clamp head configured to clamp onto relatively thin boards and expand for relatively thick boards like the clamp head 104 of FIG. 1.

The lower support structure 1402 in an example embodiment includes two (e.g., U-shaped) lower supports 1406 spaced apart from each other and configured to support the bottom side of the board. Each lower support 1406 includes an optional pillow/cushion 1408 that contours to and protects a board, and each defines a lower support recess 1410 configured to receive the bottom side of the board. Outer ends of the lower supports 1406 may be angled/ramped outward as shown to guide a board into the lower support recesses 1410.

Like the example embodiment of FIG. 1, the apparatus 1400 includes two adjustable heads 1404 and two lower supports 1406 for each adjustable head 1404. However, these two sets are not oriented as mirror images of each other. Instead, both sets are oriented to face essentially the same way with an optional angular offset. Alternately, the apparatus 1400 can include only one adjustable head 1404 and two lower supports 1406 for the adjustable head 1404.

As can be seen in FIG. 4, the apparatus 1400 further includes a clamp assembly 1412 to which the adjustable head 1404 is secured. The clamp assembly includes a bungee (see FIG. 5A) disposed therein that is under tension and thereby urges the adjustable head 1404 downward toward the lower supports 1406. The apparatus further includes one or more hooks 1420. These hooks 1420 can be used to hang a wide variety of equipment, for example, life jackets etc. Also available are recesses 1422, 1424 disposed in an accessory 1426 that can be used, for example, to hold flagpoles (see FIG. 17). One or more of the hooks 1420 can also be formed in the accessory 1426.

Figure 16A:
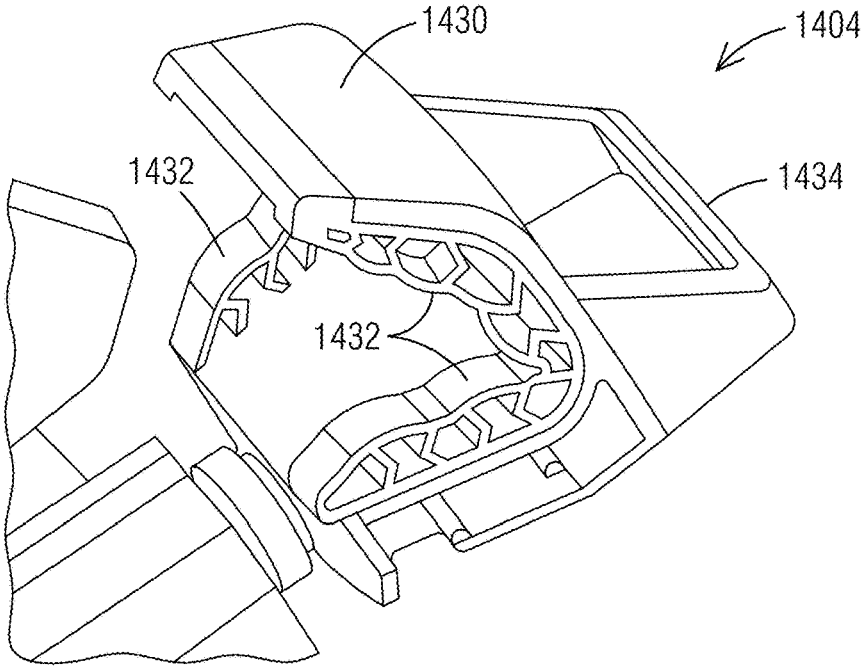
FIGS. 16A and 16B show the clamp head of the watersports board storage rack of FIG. 14.
Figure 16B:
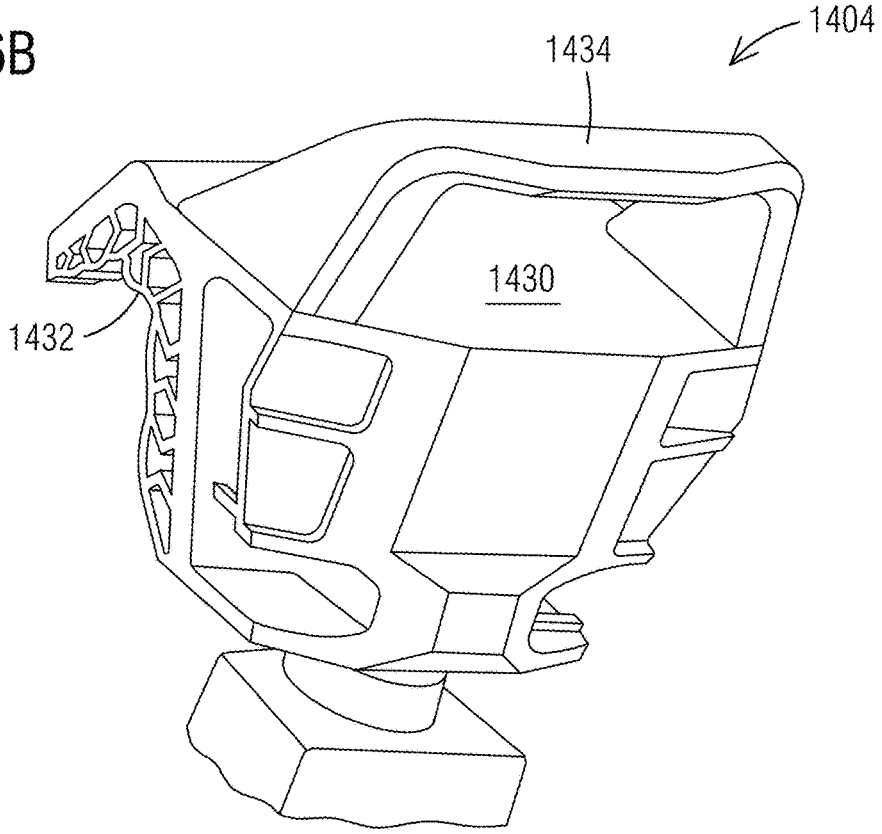

FIGS. 16A and 16B show a closeup of the adjustable head 1404 having a rigid support 1430 with a pillow structure 1432 that is overmolded onto the rigid support 1430. Alternately, the pillow structure 1432 can be mechanically attached to the rigid support 1430. Further included is a handle 1434 suitable for lifting and lowering the adjustable head 1404.

Figure 17:
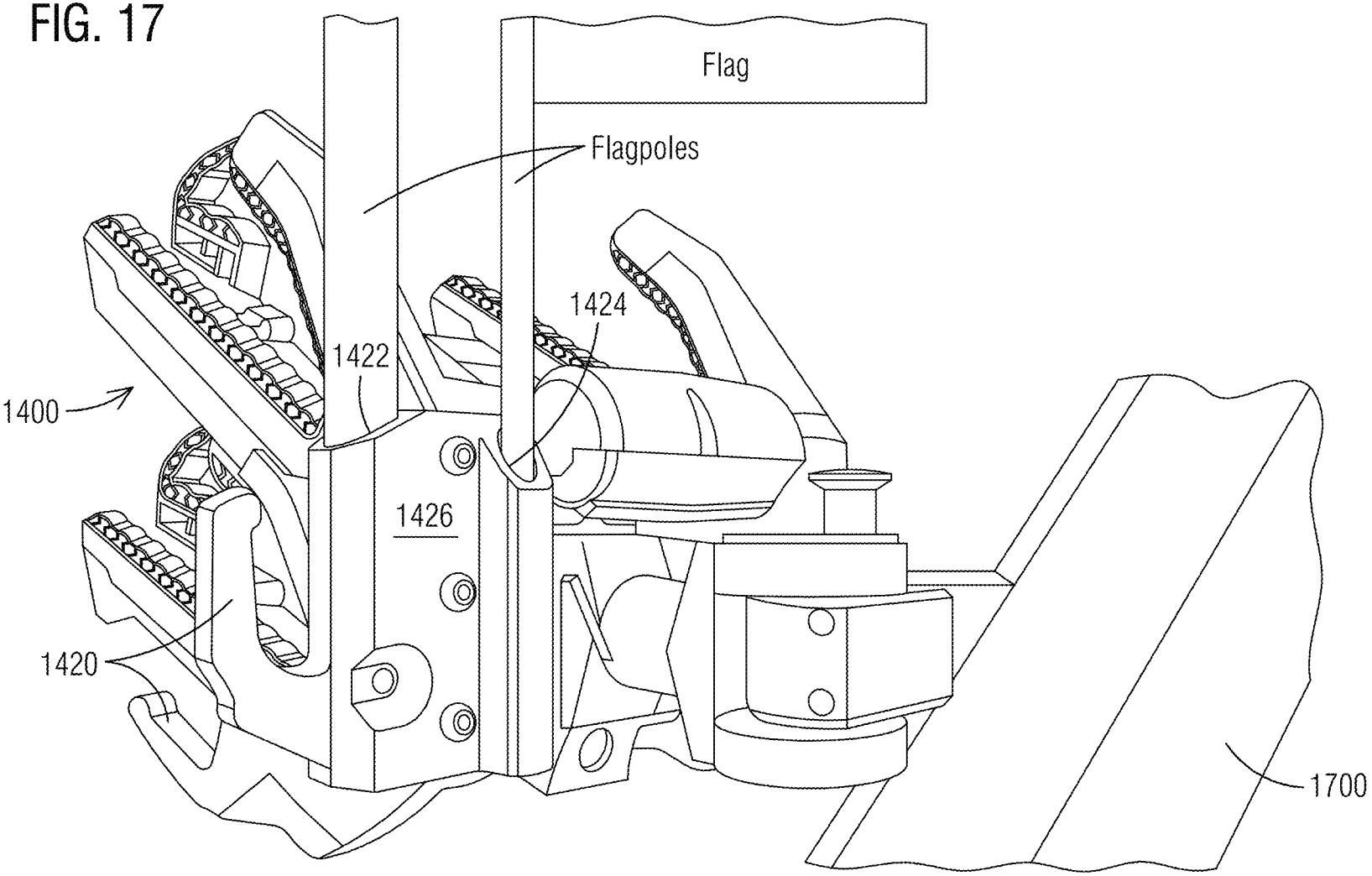
FIG. 17 shows accessories of the watersports board storage rack of FIG. 14.

FIG. 17 shows the apparatus 1400 mounted in a horizontal orientation to a tower 1700 of a marine vessel. Visible are the accessory 1426 with the recesses 1422, 1424 and a hook 1420, and example flagpoles.

As has been disclosed above, the present inventor has devised an apparatus with features that are improvements in the art. All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. An apparatus, comprising:

a lower support structure configured to support a bottom side of a board disposed thereon, wherein the board can be any one of a variety of various sized boards; and an adjustable clamp head comprising a resilient structure that defines a recess configured to capture therein a top side of the board and thereby hold the board between the clamp head and the lower support structure when the clamp head is lowered onto the top side of the board;

wherein the resilient structure is configured to narrow the recess when the clamp head is lowered against a resilience of the resilient structure onto a relatively thin board sized to contact the resilient structure at an apex of the recess without fully filling an opening of the recess;

wherein the resilient structure comprises a central region that at least partly defines the apex of the recess, wherein the apparatus is configured to lower the central region onto the relatively thin board, wherein when the clamp head is further lowered against the resilience of the resilient structure the central region yields upward, and wherein the resilient structure is configured to narrow the recess when the central region yields upward;

wherein the resilient structure comprises a lip that at least partly defines the opening of the recess, wherein when the central region yields upward the central region draws the lip toward the relatively thin board, thereby narrowing the recess; and wherein the resilient structure comprises a relief notch disposed adjacent the lip and configured to widen when the lip narrows the recess.

2. The apparatus of claim 1, wherein the clamp head is further configured to narrow the recess until a size of the opening of the recess matches a thickness of the relatively thin board.

3. The apparatus of claim 1, wherein the resilient structure is (original) configured to widen the recess when the clamp head is lowered against the resilience of the resilient structure onto a relatively thick board sized to fully fill the opening before contacting the resilient structure at the apex of the recess.

4. The apparatus of claim 1, wherein the resilient structure comprises a stationary side that is disposed on an opposite side of the central region from the lip, and wherein the central region comprises a shape configured to urge the relatively thin board against the stationary side as the clamp head settles onto the relatively thin board.

5. The apparatus of claim 1, wherein the resilient structure is configured to widen the recess when the clamp head is lowered against the resilience of the resilient structure onto a relatively thick board sized to fully fill the opening before contacting the resilient structure at the apex of the recess by allowing the lip to deflect outward.

6. An apparatus, comprising:

a lower support structure configured to support a bottom edge of a board disposed thereon, wherein the board can be any one of a variety of various sized boards; and an adjustable clamp head comprising a resilient structure that defines a recess configured to capture therein a upper end of the board and thereby hold the board between the clamp head and the lower support structure when the clamp head is lowered onto the upper end of the board, wherein the resilient structure comprises a lip that at least partly defines an opening of the recess and a tension element that at least partly defines an apex of the recess and that is connected to the lip;

wherein when the clamp head is lowered against a resilience of the resilient structure onto a relatively thin board sized to contact the tension element without fully filling the opening the tension element yields upward which pulls the lip inward, thereby narrowing the recess; and wherein the resilient structure comprises a relief notch disposed adjacent the lip and configured to change shape when the tension element pulls on the lip.

7. The apparatus of claim 6, wherein the resilient structure comprises a stationary side that is disposed on an opposite side of the tension element from the lip, and wherein the tension element comprises a shape configured to urge the relatively thin board against the stationary side as the clamp head settles onto the relatively thin board.

8. The apparatus of claim 7, wherein the shape comprises a ramp disposed at an acute angle to the stationary side.

9. The apparatus of claim 6, wherein the lip is configured to deflect outward and thereby widen the recess when the clamp head is lowered against the resilience of the resilient structure onto a relatively thick board sized to fully fill the opening before contacting the tension element.

10. The apparatus of claim 9, wherein the resilient structure comprises a stationary side that is disposed on an opposite side of the tension element from the lip, and wherein as the lip is deflected outward the resilience of the resilient structure resists the deflection, and wherein the resistance to the deflection urges the relatively thick board against the stationary side.

11. An apparatus, comprising:

a clamp head comprising a resilient structure that defines a recess configured to capture therein an upper end of a board and thereby hold the board when the clamp head is lowered onto the upper end of the board, wherein the resilient structure comprises a lip that at least partly defines an opening of the recess and a tension element that at least partly defines an apex of the recess and that is connected to the lip;

wherein when the clamp head is lowered against a resilience of the resilient structure onto a relatively thin board sized to contact the tension element without fully filling the opening the tension element yields upward which pulls the lip inward, thereby narrowing the recess; and wherein the resilient structure comprises a relief notch disposed adjacent the lip and configured to change shape when the tension element pulls on the lip.

12. The apparatus of claim 11, wherein the resilient structure comprises a stationary side that is disposed on an opposite side of the tension element from the lip, and wherein the tension element comprises a shape configured to urge the relatively thin board against the stationary side as the clamp head settles onto the relatively thin board.

13. The apparatus of claim 12, wherein the shape comprises a ramp disposed at an acute angle to the stationary side.

14. The apparatus of claim 11, wherein the lip is configured to deflect outward and thereby widen the recess when the clamp head is lowered against the resilience of the resilient structure onto a relatively thick board sized to fully fill the opening before contacting the tension element inside the recess.

15. The apparatus of claim 14, wherein the resilient structure comprises a stationary side that is disposed on an opposite side of the tension element from the lip, and wherein as the lip is deflected outward the resilience of the resilient structure resists the deflection, and wherein the resistance to the deflection urges the relatively thick board against the stationary side.

* * * * *